US010201253B1

(12) United States Patent
Jackson

(10) Patent No.: US 10,201,253 B1
(45) Date of Patent: Feb. 12, 2019

(54) MOUNTED BACK CLEANING ASSEMBLY

(71) Applicant: Prince Jackson, Clarksville, TN (US)

(72) Inventor: Prince Jackson, Clarksville, TN (US)

( * ) Notice: Subject to any disclaimer, the term of this patent is extended or adjusted under 35 U.S.C. 154(b) by 0 days.

(21) Appl. No.: 15/813,266

(22) Filed: Nov. 15, 2017

(51) Int. Cl.
*A47K 7/02* (2006.01)
*A47K 7/04* (2006.01)
*A47K 5/12* (2006.01)

(52) U.S. Cl.
CPC ..... *A47K 7/024* (2013.01); *A47K 7/04* (2013.01); *A47K 5/12* (2013.01); *A47K 2201/02* (2013.01)

(58) Field of Classification Search
CPC ..... A47K 7/024; A47K 7/022; A47K 7/04; A47K 5/12
USPC ..... 4/606
See application file for complete search history.

(56) References Cited

U.S. PATENT DOCUMENTS 4,424,687 A 1/1984 Morgan
5,052,184 A 10/1991 Jarvis
5,052,185 A 10/1991 Spahr
6,050,663 A 4/2000 Schoellmann
6,126,124 A 10/2000 Wagner
D484,003 S 12/2003 Bozych
7,120,947 B1 * 10/2006 Magallanes ..... A47K 7/024 4/606
7,313,928 B2 1/2008 Girard
8,458,840 B2 * 6/2013 Galindo Sanchez .. A47K 7/024 15/21.1
2006/0107473 A1 * 5/2006 Torres ..... A47K 7/024 15/21.1
2009/0241257 A1 * 10/2009 Malta ..... A47K 7/024 4/606
2012/0151944 A1 6/2012 Carlson
2017/0172358 A1 * 6/2017 Sainio ..... A47K 7/024
2017/0280945 A1 * 10/2017 Verrengia ..... A47K 7/04

* cited by examiner

*Primary Examiner* — Huyen Le

(57) ABSTRACT

A mounted back cleaning assembly for cleaning the back of a person includes a housing that comprises a front wall, a back wall and a perimeter wall that is attached to and extends between the front and back walls. The perimeter wall has a top side, a bottom side, a first lateral wall and a second lateral wall. A plurality of mounts is attached to the back wall and removably attachable to a vertical surface such that the back wall is secured thereto. A back scrubber unit is mounted on the front wall and moves alternatingly between the first and second lateral walls when actuated. A plurality of water spouts is mounted to the housing and directed outwardly away from the front wall. A conduit is in fluid communication with the water spouts and fluidly coupled to a water supply. A soap dispenser is positioned in the housing.

16 Claims, 6 Drawing Sheets

MOUNTED BACK CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to back washing devices and more particularly pertains to a new back washing device for cleaning a person's back.

BRIEF SUMMARY OF THE INVENTION

An embodiment of the disclosure meets the needs presented above by generally comprising a housing that has a front wall, a back wall and a perimeter wall that is attached to and extends between the front wall and the back wall. The perimeter wall has a top side, a bottom side, a first lateral wall and a second lateral wall. A plurality of mounts is attached to the back wall. Each of the mounts is configured to be removably attached to a vertical surface such that the back wall is held adjacent to the vertical surface. A back scrubber unit is mounted on the front wall. The back scrubbing unit moves laterally back and forth between the first and second lateral walls when the back scrubber unit is turned on. A plurality of water spouts is mounted to the housing and is directed outwardly away from the front wall. Each of the water spouts are positioned adjacent to the top side. A conduit is in fluid communication with each of the water spouts. The conduit is configured to be fluidly coupled to a water supply. The conduit extends through the housing. A soap dispenser is positioned in the housing. The soap dispenser configured to contain and dispense liquid soap outwardly from the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
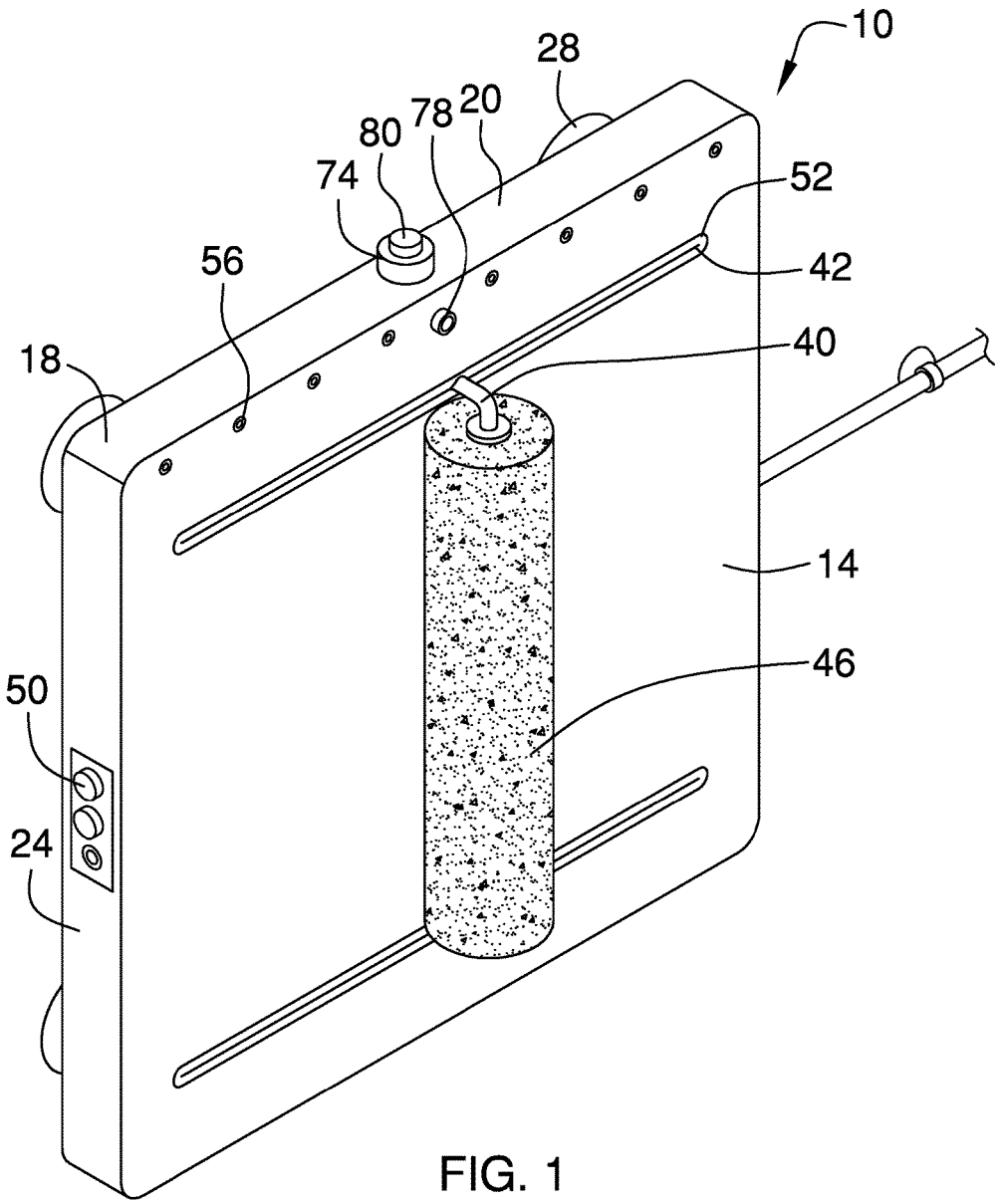
FIG. 1 is a top side view of a mounted back cleaning assembly according to an embodiment of the disclosure.
Figure 2:
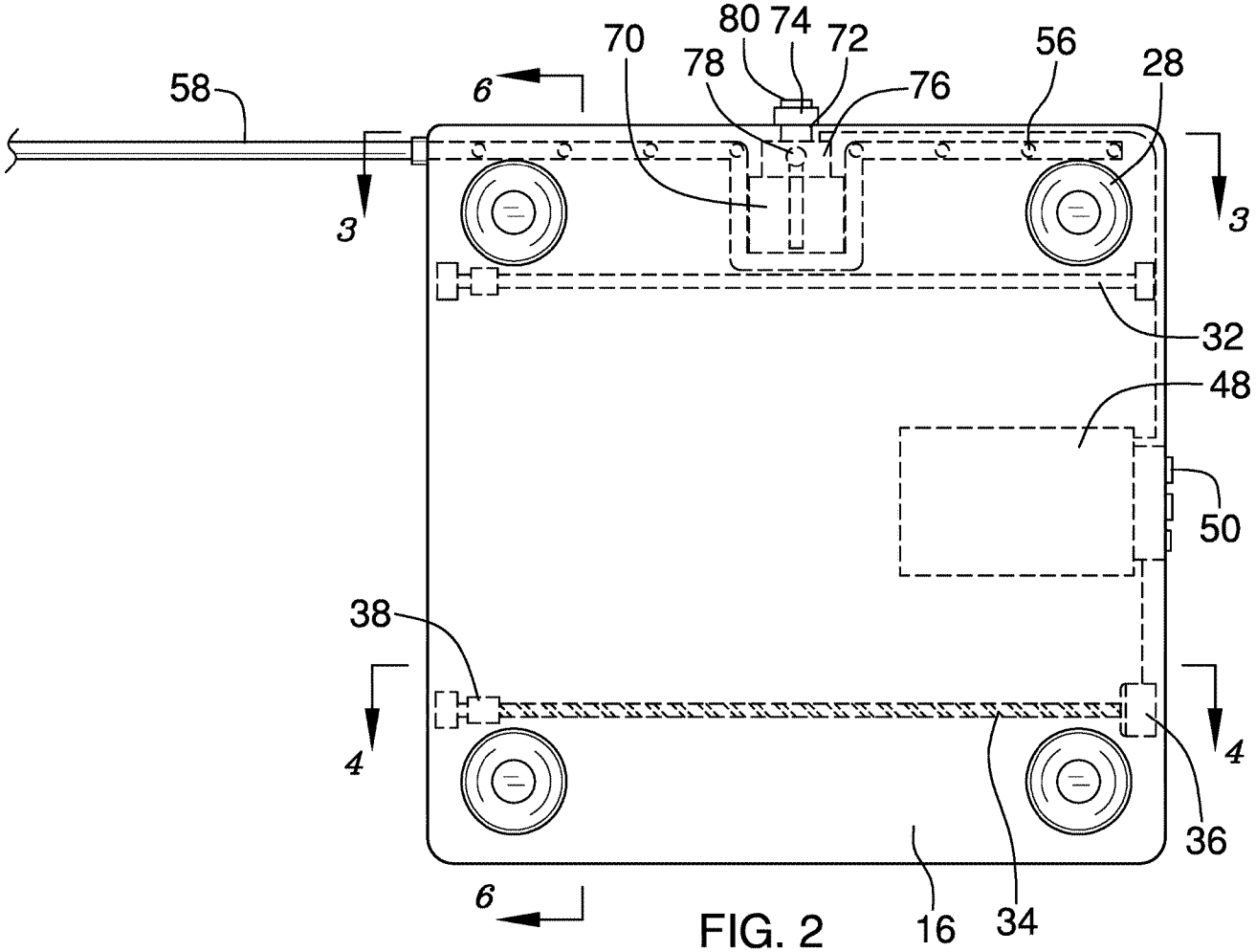
FIG. 2 is a back view of an embodiment of the disclosure.
Figure 3:
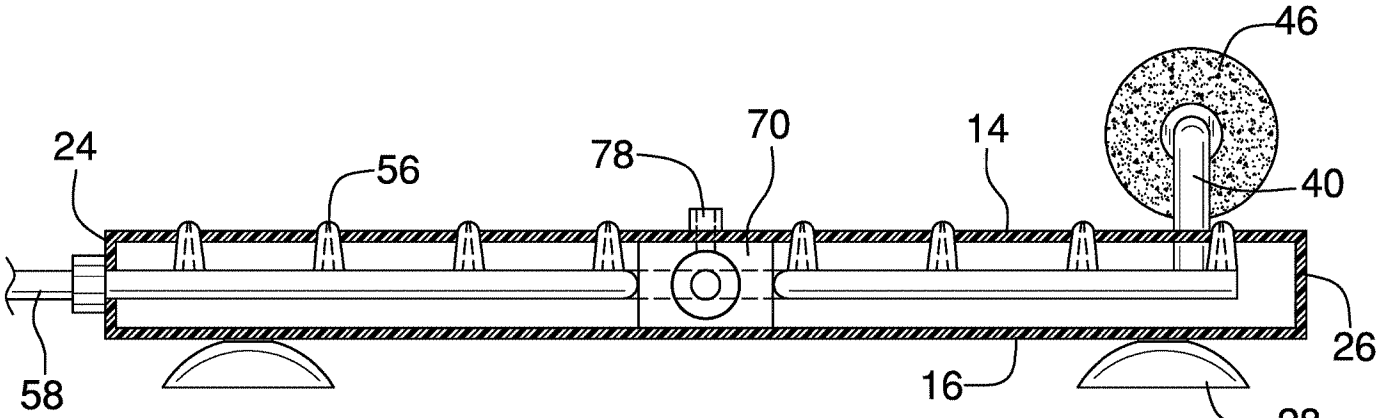
FIG. 3 is a cross-sectional view of an embodiment of the disclosure taken along line 3-3 of FIG. 2.
Figure 4:
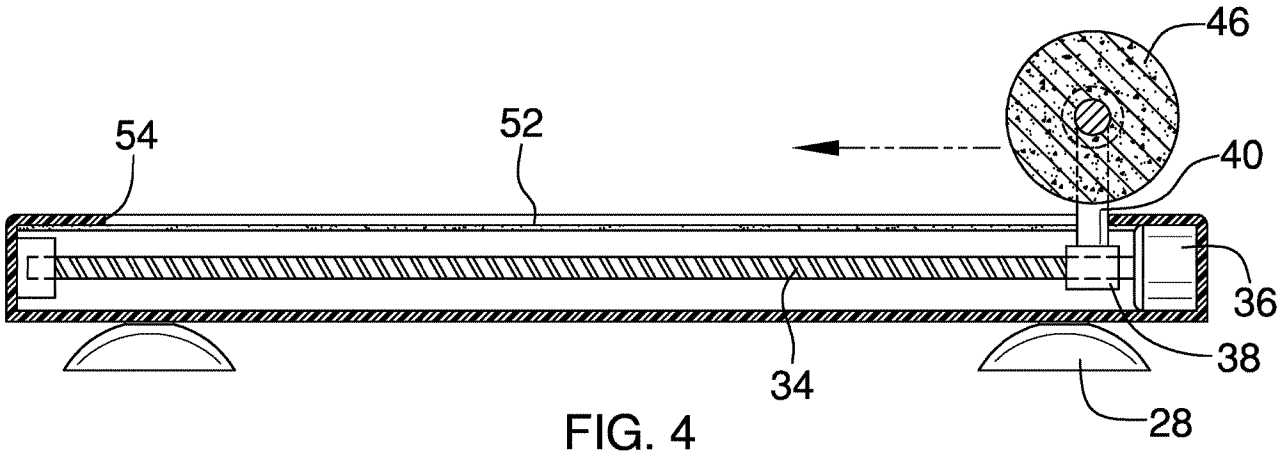
FIG. 4 is a cross-sectional view of an embodiment of the disclosure taken along line 4-4 of FIG. 2.
Figure 5:
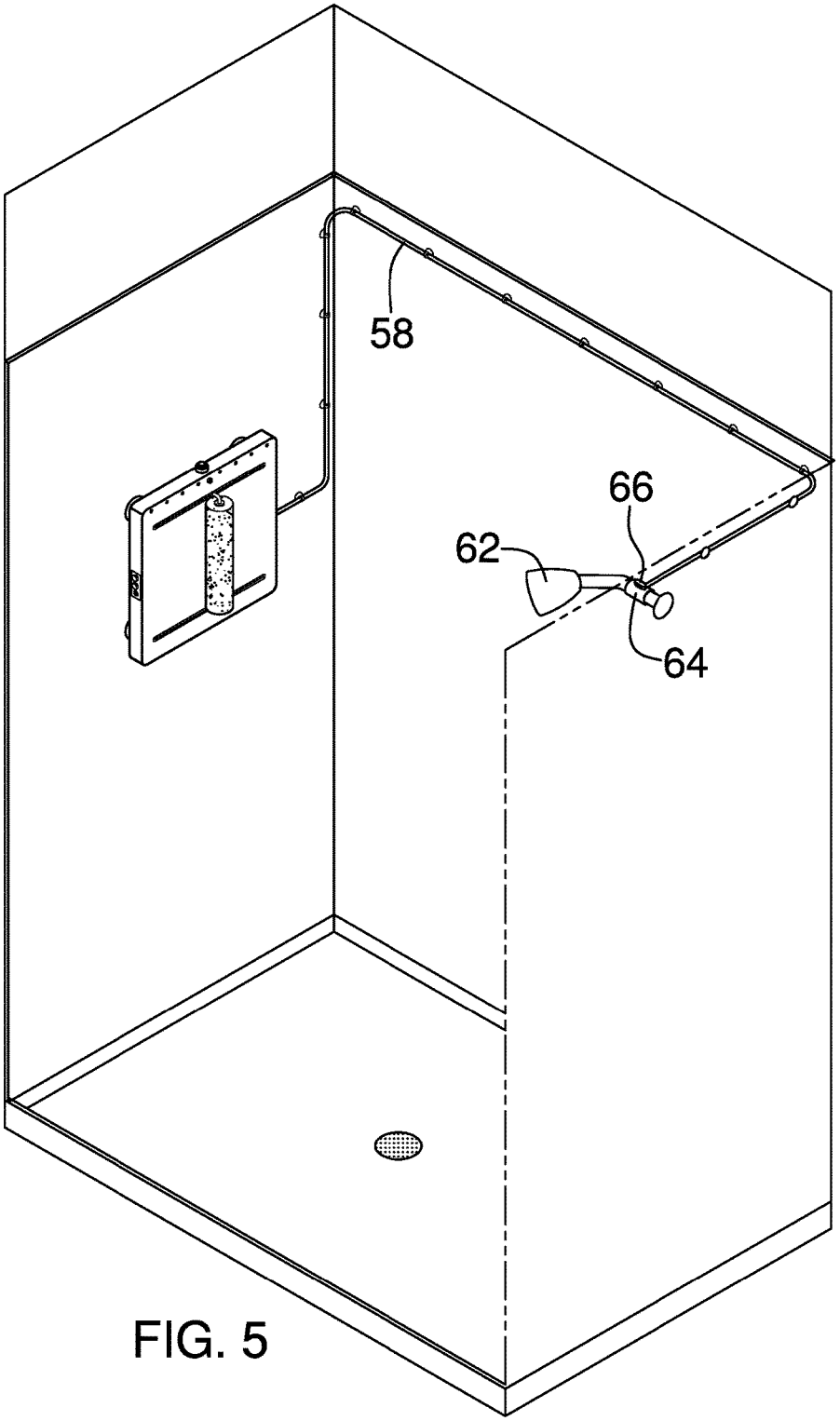
FIG. 5 is a top side view of an embodiment of the disclosure.
Figure 6:
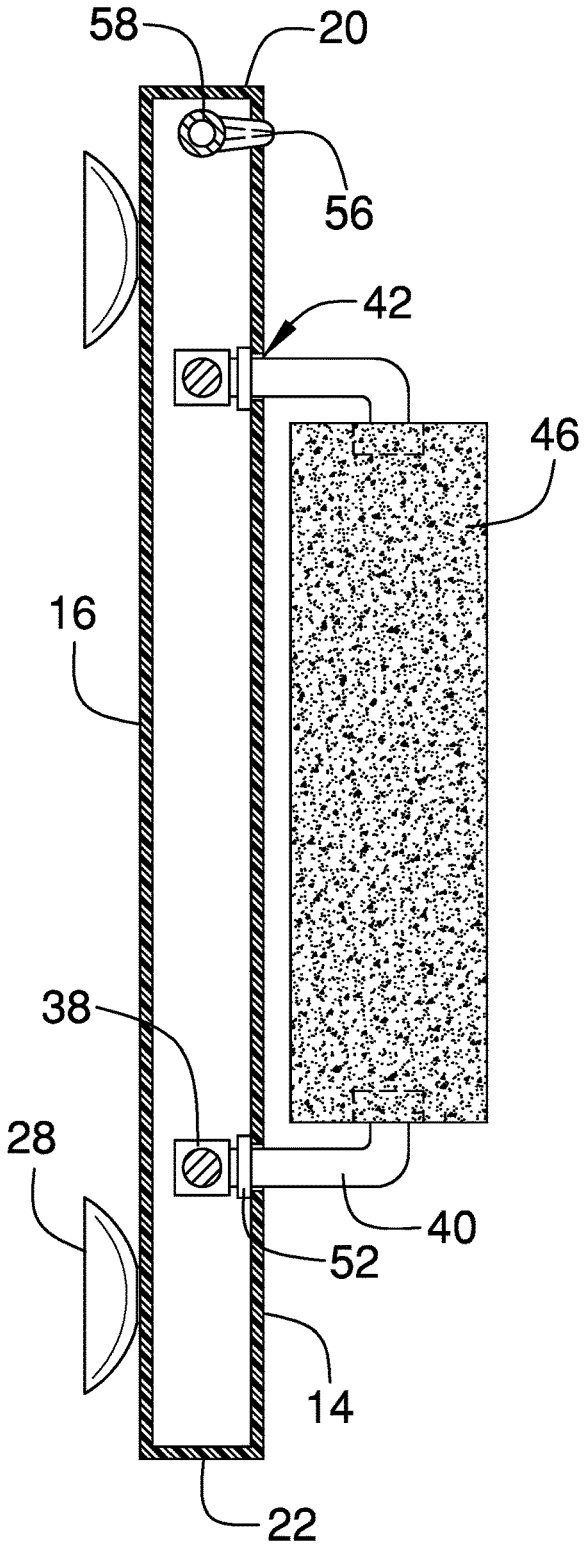
FIG. 6 is a cross-sectional view of an embodiment of the disclosure taken along line 6-6 of FIG. 2.
Figure 7:
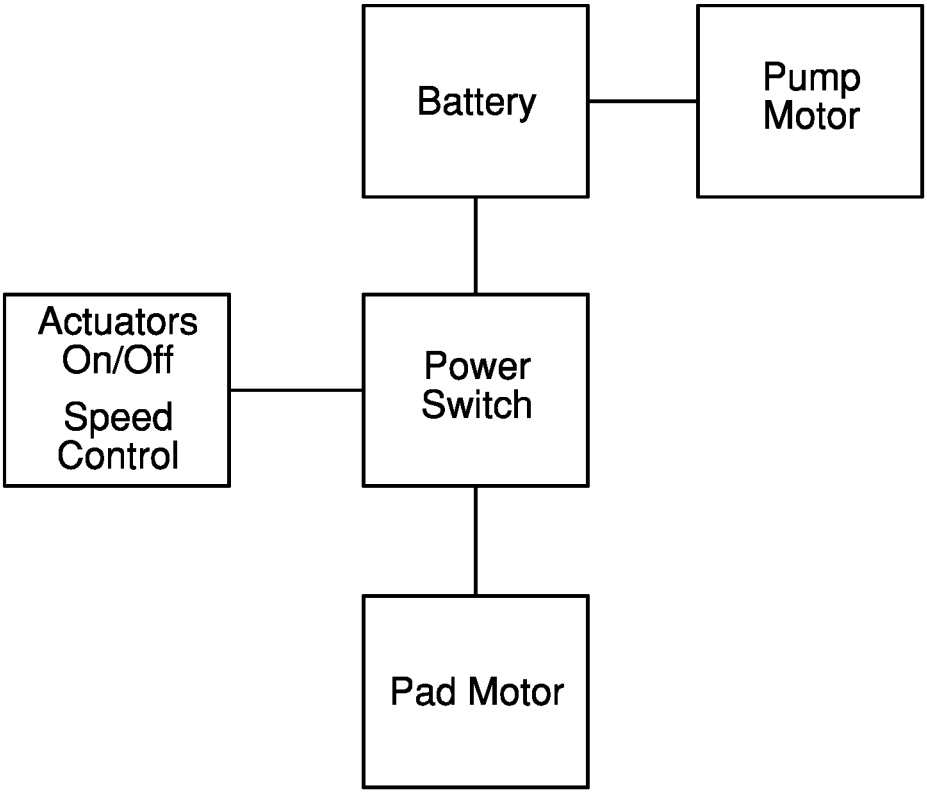
FIG. 7 is a schematic box view of an embodiment of the disclosure.

With reference now to the drawings, and in particular to FIGS. 1 through 7 thereof, a new back washing device embodying the principles and concepts of an embodiment of the disclosure and generally designated by the reference numeral 10 will be described.

As best illustrated in FIGS. 1 through 7, the mounted back cleaning assembly 10 generally comprises a housing 12 that comprises a front wall 14, a back wall 16 and a perimeter wall 18 that is attached to and extends between the front wall 14 and the back wall 16. The perimeter wall 18 has a top side 20, a bottom side 22, a first lateral wall 24 and a second lateral wall 26. A plurality of mounts 28 is attached to the back wall 16. Each of the mounts 28 is removably attached to a vertical surface 30 such that the back wall 16 is held adjacent to the vertical surface 30. Each of the mounts 28 may comprise a suction cup. The housing 12 has a length that is between 10 inches and 18 inches, a height that is between 10 inches and 18 inches and a width that is between 0.5 inches and 2 inches.

A back scrubber unit is mounted on the front wall 14. The back scrubbing unit moves laterally back and forth between the first 24 and second lateral walls 26 when the back scrubber unit is turned on. The back scrubber unit includes a pair of guides 32 that is mounted within the housing 12. Each of the guides 32 is horizontally orientated and elongated. Each of the guides 32 is vertically displaced with respect to each other. At least one of the guides 32 comprises a drive shaft 34 and is rotatable with respect to the housing 12. The drive shaft 34 is threaded. Each of the guides 32 is attached to and extends between the first 24 and second lateral walls 26.

A motor 36 is mounted in the housing 12. The motor 36 is mechanically coupled to the drive shaft 34. The motor 36 alternatingly rotates the drive shaft 34 about its longitudinal axis in a first direction and then a second direction when the motor 36 is turned on.

A support 38 is attached to the guides 32. The support 38 extends through the front wall 14. The support 38 includes a pair of posts 40. The front wall 14 has a pair of elongated slots 42 that extend therethrough. Each of the slots 42 is aligned with one of the guides 32. Each of the posts 40 is extended through one of the slots 42. The posts 40 each have an internal end that is mounted to an associated one of the guides 32. The internal end of the post 40 is attached to the drive shaft 34 to define a drive coupler 44. The drive coupler 44 is threadably mounted to the drive shaft 34 such that the drive coupler 44 is moved toward the first lateral wall 24 when the drive shaft 34 is rotated in the first direction and toward the second lateral wall 26 when the drive shaft 34 is rotated in the second direction. A pair of seals 52 is included and each of the slots 42 has a perimeter edge 54 that has one of the seals 52 mounted thereon. Each of the seals 52 inhibits water from entering the housing 12 through the slots 42.

A pad 46 is removably attached to the support 38. The pad 46 may be rotatable with respect to the support 38. The pad 46 has a cylindrical shape and has a rotational axis orientated perpendicular to the slots 42. The pad 46 may comprise of soft bristle brush, firm bristle brush, sponge or terry cloth but may be any other material suitable for cleaning skin. The pad 46 has a vertical length that is between 8 inches and 14 inches.

A battery 48, or other power source, is mounted within the housing 12 and is electrically coupled to the motor 36. The battery 48 may comprise a rechargeable battery. A power switch 50 is mounted on the housing 12 and is electrically coupled to the motor 36. The power switch 50 is actuated to turn the motor 36 on and off. The power switch may include speed controls which direct the speed at which the drive shaft rotates.

A plurality of water spouts 56 is mounted to the housing 12 and is directed outwardly away from the front wall 14. Each of the water spouts 56 is positioned adjacent to the top side 20. A conduit 58 is in fluid communication with each of the water spouts 56 and the conduit is 58 fluidly coupled to a water supply 60. The conduit 58 extends through the housing 12.

The water supply 60 may comprise a showerhead 62. A showerhead adjuster 64 may be used to funnel water from the showerhead 62 into the conduit 58. A valve 66 is attached to the showerhead adjuster 64. The valve 66 may have a first position to allow water to flow out of the showerhead 62, a second position to allow water to flow into both the showerhead 62 and the conduit 58 and a third position to allow water to flow into the conduit 58.

A soap dispenser 68 is positioned in the housing 12. The soap dispenser 68 contains and dispenses liquid soap outwardly from the housing 12. The soap dispenser 68 includes a container 70 that is positioned within the housing 12 and the container 70 holds the liquid soap. The top side 20 has an opening 72 that exposes the container 70 for receiving liquid soap into the container 70. A cap 74 is removably positioned on the opening to close the opening. A pump 76 is positioned in and in fluid communication with the container 70. The pump 76 has a dispensing end 78 that extends outwardly through the front wall 14. The dispensing end 78 is positioned adjacent to the top side 20. The pump 76 is electrically coupled to the battery 48. An actuator 80 is positioned on the distal end of the cap 74 relative to the container 70. The actuator 80 actuates the pump 76 such that the liquid soap is dispensed from the dispensing end 78.

In use, the mounts 28 are attached to the vertical surface 30 to secure the housing 12 to the vertical surface 30. The conduit 58 is attached to the water supply 60 and the valve 66 is opened to allow water to flow outwardly from each of the water spouts 56. The actuator 80 is activated to release liquid soap onto the pad 46 or onto a person's hands which can be used to lather the pad 46 with liquid soap. The power switch 50 is turned on to actuate the drive coupler 44 which then moves the pad 46 laterally back and forth across the front wall 14. The person then presses their back against moving pad 46 such that the pad 46 rotates along its axis against the person's back to spread the liquid soap and scrub the back as the water spout releases water to rinses the soap off therein cleaning the person's back.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mounted back washer assembly configured to wash a person's back during a shower, said assembly comprising:

a housing comprising a front wall, a back wall and a perimeter wall attached to and extending between said front wall and said back wall, said perimeter wall having a top side, a bottom side, a first lateral wall and a second lateral wall;

a plurality of mounts being attached to said back wall, each of said mounts being configured to be removably attached to a vertical surface such that said back wall is held adjacent to said vertical surface;

a back scrubber unit being mounted on said front wall, said back scrubbing unit moving laterally back and forth between said first and second lateral walls when said back scrubber unit is turned on;

a plurality of water spouts being mounted to said housing and being directed outwardly away from said front wall, said water spouts each being positioned adjacent to said top side;

a conduit being in fluid communication with each of said water spouts, said conduit being configured to be fluidly coupled to a water supply, said conduit extending through said housing; and a soap dispenser being positioned in said housing, said soap dispenser configured to contain and dispense liquid soap outwardly from said housing.

2. The mounted back washer assembly according to claim 1, wherein each of said mounts comprises a suction cup.

3. The mounted back washer assembly according to claim 1, wherein said back scrubber unit includes a pair of guides being mounted within said housing, each of said guides is horizontally orientated and elongated, said guides being vertically displaced with respect to each other, said guides are attached to and extending between said first and second lateral walls.

4. The mounted back washer assembly according to claim 3, wherein at least one of said guides comprises a drive shaft being rotatable with respect to said housing.

5. The mounted back washer assembly according to claim 4, wherein said drive shaft is threaded.

6. The mounted back washer assembly according to claim 4, wherein said back scrubber unit includes a motor being mounted in said housing, said motor being mechanically coupled to said drive shaft, said motor alternatingly rotating said drive shaft about its longitudinal axis in a first direction and then a second direction when said motor is turned on.

7. The mounted back washer assembly according to claim 6, wherein said back scrubber unit includes a support being attached to said guides, said support extending through said front wall, said support including a pair of posts, said front wall having a pair of elongated slots extending therethrough, each of said slots being aligned with one of said guides, each of said posts extending through one of said slots, each of said posts having an internal end being mounted to an associated one of said guides, said internal end of said post attached to said drive shaft defining a drive coupler, said drive coupler being threadably mounted to said drive shaft such that said drive coupler is moved toward said first lateral wall when said drive shaft is rotated in said first direction and toward said second lateral wall when said drive shaft is rotated in said second direction.

8. The mounted back washer assembly according to claim 7, wherein said back scrubber unit includes a pad being removably attached to said support, said pad being rotatable with respect to said support, said pad having a cylindrical shape and having a rotational axis orientated perpendicular to said slots.

9. The mounted back washer assembly according to claim 7, further including a pair of seals, each of said slots having a perimeter edge having one of said seals mounted thereon, said seals inhibiting water from entering said housing through said slots.

10. The mounted back washer assembly according to claim 6, wherein said back scrubber unit includes a battery being mounted within said housing and being electrically coupled to said motor, said battery being a rechargeable battery.

11. The mounted back washer assembly according to claim 6, wherein said back scrubber unit includes a power switch being mounted on said housing and being electrically coupled to said motor, said power switch being actuated to turn said motor on and off.

12. The mounted back washer assembly according to claim 1, wherein said soap dispensing unit includes a container being positioned within said housing, said container being configured to hold the liquid soap, said top side having an opening exposing said container to facilitate filling of said container.

13. The mounted back washer assembly according to claim 1, wherein said soap dispensing unit includes a cap being removably positioned on said opening to close said opening.

14. The mounted back washer assembly according to claim 13, wherein said soap dispensing unit includes a pump being positioned in and in fluid communication with said container, said pump having a dispensing end extending outwardly through said front wall, said dispensing end being positioned adjacent to said top side, said pump being electrically coupled to said battery.

15. The mounted back washer assembly according to claim 14, wherein said soap dispensing unit includes an actuator being positioned on said distal end of said cap from said container, said actuator actuating said pump such that the liquid soap is dispensed from said dispending end.

16. A mounted back washer assembly configured to wash a person's back during a shower, said assembly comprising:

a housing comprising a front wall, a back wall and a perimeter wall attached to and extending between said front wall and said back wall, said perimeter wall having a top side, a bottom side, a first lateral wall and a second lateral wall;

a plurality of mounts being attached to said back wall, each of said mounts being configured to be removably attached to a vertical surface such that said back wall is held adjacent to said vertical surface, each of said mounts comprising a suction cup;

a back scrubber unit being mounted on said front wall, said back scrubbing unit moving laterally back and forth between said first and second lateral walls when said back scrubber unit is turned on, said back scrubber unit including:

a pair of guides being mounted within said housing, each of said guides being horizontally orientated and elongated, said guides being vertically displaced with respect to each other, at least one of said guides comprising a drive shaft being rotatable with respect to said housing, said drive shaft being threaded, said guides being attached to and extending between said first and second lateral walls;

a motor being mounted in said housing, said motor being mechanically coupled to said drive shaft, said motor alternatingly rotating said drive shaft about its longitudinal axis in a first direction and then a second direction when said motor is turned on;

a support being attached to said guides, said support extending through said front wall, said support including a pair of posts, said front wall having a pair of elongated slots extending therethrough, each of said slots being aligned with one of said guides, each of said posts extending through one of said slots, each of said posts having an internal end being mounted to an associated one of said guides, said internal end of said post attached to said drive shaft defining a drive coupler, said drive coupler being threadably mounted to said drive shaft such that said drive coupler is moved toward said first lateral wall when said drive shaft is rotated in said first direction and toward said second lateral wall when said drive shaft is rotated in said second direction;

a pad being removably attached to said support, said pad being rotatable with respect to said support, said pad having a cylindrical shape and having a rotational axis orientated perpendicular to said slots;

a battery being mounted within said housing and being electrically coupled to said motor, said battery being a rechargeable battery;

a power switch being mounted on said housing and being electrically coupled to said motor, said power switch being actuated to turn said motor on and off;

a pair of seals, each of said slots having a perimeter edge having one of said seals mounted thereon, said seals inhibiting water from entering said housing through said slots;

a plurality of water spouts being mounted to said housing and being directed outwardly away from said front wall, each of said water spouts being positioned adjacent to said top side;

a conduit being in fluid communication with each of said water spouts, said conduit being configured to be fluidly coupled to a water supply, said conduit extending through said housing;

a soap dispenser being positioned in said housing, said soap dispenser configured to contain and dispense liquid soap outwardly from said housing, said soap dispenser including:

a container being positioned within said housing, said container being configured to hold the liquid soap, said top side having an opening exposing said container to facilitate filling of said container;

a cap being removably positioned on said opening to close said opening;

a pump being positioned in and in fluid communication with said container, said pump having a dispensing end extending outwardly through said front wall, said dispensing end being positioned adjacent to said top side, said pump being electrically coupled to said battery; and an actuator being positioned on said distal end of said cap from said container, said actuator actuating said pump such that the liquid soap is dispensed from said dispending end.

* * * * *